United States Patent [19]

Stauffer

[11] Patent Number: 4,693,766

[45] Date of Patent: Sep. 15, 1987

[54] HIGH SPEED TAIL SEALING APPARATUS

[75] Inventor: Nelson R. Stauffer, Factoryville, Pa.

[73] Assignee: Karnel Corporation, Clarks Summit, Pa.

[21] Appl. No.: 777,192

[22] Filed: Sep. 18, 1985

[51] Int. Cl.[4] ..... B65H 81/00

[52] U.S. Cl. ..... 156/64; 156/357; 156/361; 156/191; 156/446

[58] Field of Search ..... 156/187, 191, 192, 361, 156/446, 357, 64; 242/57, 56 R, 67.1, 67.3

[56] References Cited

U.S. PATENT DOCUMENTS

| | | | |
|---|---|---|---|
| 1,988,255 | 1/1935 | Soons | 242/57 X |
| 3,044,532 | 7/1962 | Ghisoni | 156/361 |
| 3,134,706 | 5/1964 | Alexander | 156/357 |
| 3,637,154 | 1/1972 | Northup | 242/57 |
| 4,299,642 | 11/1981 | Berkholtz | 156/191 |

*Primary Examiner*—David Simmons

*Attorney, Agent, or Firm*—Andrus, Sceales, Starke & Sawall

[57] ABSTRACT

A high speed apparatus for sealing the tail of a wound roll of sheet material. A pair of parallel rotatable rollers define a tail separation station and a tail wind-up station that are disposed longitudinally along the length of the rollers. An entry station is located parallel to the tail separating station and a pivotable kicker is positioned to engage a roll at an over-center position to impart rotation to the roll and transfer the roll to the tail separation station. Air jets located at the tail separation station act to separate the tail from the body of the roll. The separated tail is drawn across a supporting surface and a sensor associated with the surface senses the end of the tail and acts to stop rotation of the rollers. As rotation of the roll stops, the separated tail falls onto a generally horizontal apron and the roll with the separated tail supported on the apron is then moved longitudinally along the non-rotating rollers to the wind-up station. As the roll is moved to the wind-up station, a bead of adhesive is applied to the separated tail by a pressurized nozzle disposed at an acute angle to the tail. The pressurized adhesive imparts a horizontal component of velocity to the tail to prevent the tail from folding over as it is moved to the wind-up station. At the wind-up station the roll is rotated to wind the separated tail back onto the body of the roll.

7 Claims, 5 Drawing Figures

HIGH SPEED TAIL SEALING APPARATUS

BACKGROUND OF THE INVENTION

In the fabrication of roll products, such as paper towelling or toilet tissue, the product is initially wound in the form of a long roll or log, which is subsequenlty cut into small rolls and packaged for shipment and sale. If the free end or tail of the roll is not securely fastened to the body of the roll, the slitting and packaging operation may not be properly performed in which event the packaging machinery may jam or excess paper from the roll may protrude from the package resulting in an unsightly appearance.

In the past, various mechanisms have been utilized for sealing the tail to the roll. In the tail sealing apparatus, as disclosed in U. S. Pat. No. 4,299,642, a pair of parallel rotatable rollers define a tail separation station and a tail wind-up station that are disposed longitudinally along the length of the rollers. The wound roll is rotated about its axis at the tail separation station and air jets mounted adjacent the rollers separate the tail from the body of the rotating roll. The separated tail is supported on an apron that extends laterally from the rollers.

As disclosed in the aforementioned patent, after separation of the tail, rotation of the rollers is stopped and the roll with the separated tail being supported on the apron, is moved longitudinally along the rollers to the wind-up station. As the roll is moved to the wind-up station, a bead of adhesive is applied to the tail from a fixed adhesive head. At the wind-up station, the roll is rotated to wind the separated tail back onto the body of the roll.

At high speed operation in which the roll is rotated in the neighborhood of 100 rpm, it is not possible to stop the roll instantaneously, due to the inertia of the roll and related mechanical drive train components. Due to the time interval required to stop the roll, continued rotation of the roll may tend to move the separated tail from the support apron. If this occurs, it is necessary to rotate the roll in the opposite direction in order to reposition the tail on the supporting apron.

It has also been found that at high speed operation, the application of the adhesive to the separated tail tends to hold the tail against the apron and resist movement of the tail from the tail separating station to the wind-up station, with the result that the tail may tend to fold over. If the tail folds over, the tail cannot be properly rewound at the wind-up station.

SUMMARY OF THE INVENTION

The invention is directed to an improved high speed apparatus for sealing the tail of a wound roll of sheet material. In accordance with the invention, a pair of parallel rotatable rollers define a tail separation station and a tail wind-up station that are disposed longitudinally along the length of the rollers. An entry station is located parallel to the tail separation station and a pivotable kicker is mounted to engage a roll at the entry station and move the roll to the tail separation station. The kicker is mounted to engage the roll at a position above a horizontal plane passing through the axis of the roll to thereby impart rotation to the roll in the same direction that the roll is subsequently rotated by the rollers. This enables the roll, when supported on the rollers, to more quickly gain high speed.

A plurality of air jets are positioned on one side of a vertical plane passing through the center line of the rotating roll and the air jets act to separate the tail from the body of the roll as the roll is rotated.

Located on the opposite side of the vertical plane extending through the center of the roll is a supporting surface and the separated tail is thrown outwardly by the air blast onto the supporting surface. Continued rotation of the roll causes the separated tail to be drawn across the supporting surface and a sensor associated with the surface senses the end of the tail and acts to stop rotation of the rollers.

As the roll stops rotation, the separated tail is drawn across the supporting surface and falls onto a generally horizontal apron that extends laterally from one of the rollers. The non-rotating roll is then moved along the rollers to the wind-up station, with the separated tail being supported on the apron.

As the roll is moved toward the wind-up station, a bead of adhesive is applied to the separated tail by a pressurized adhesive nozzle which is disposed at an angle to the horizontal. The pressurized adhesive imparts a horizontal component of velocity to the tail, in the direction of movement of the tail, which prevents folding over of the tail as it is moved to the wind-up station.

At the wind-up station, the roll is again rotated to wind the separated tail back onto the body of the roll.

The invention is an improvement to the tail sealing apparatus of U.S. Pat. No. 4,299,642 and enables the apparatus to operate at higher speeds. Through the construction and location of the air jets, the supporting surface and sensor, and the apron, it is assured that the tail will be supported on the apron at high speed operation, even though the roll may not stop instantaneously due to the inertia of the high speed rotation.

The pressurized adhesive application, along with its angular disposition, imparts a horizontal component of velocity to the tail which prevents the tial from folding over under high speed movement.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figures 1, 5:
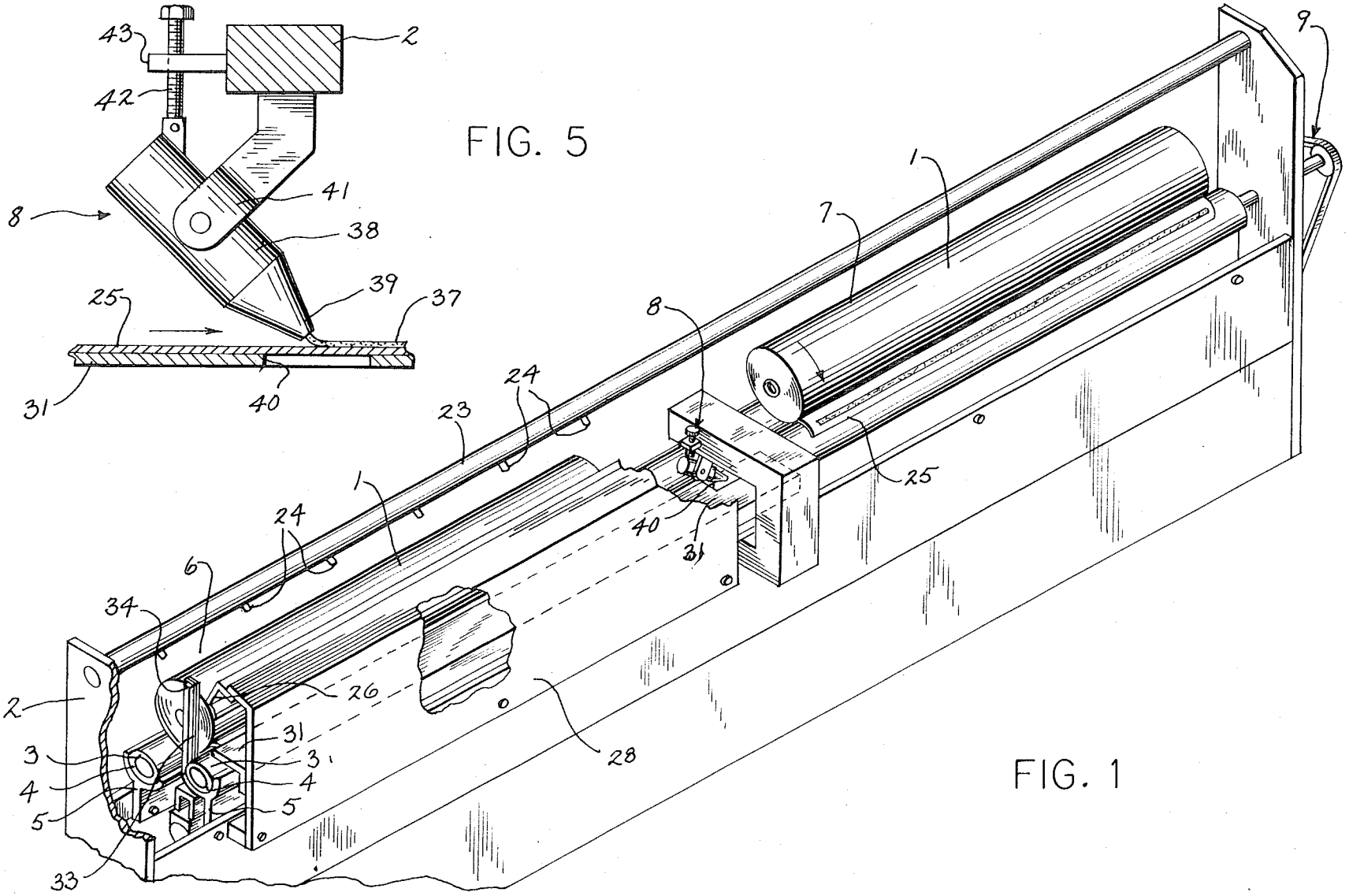
FIG. 1 is a perspective view of a tail sealing apparatus of the invention.
FIG. 5 is a fragmentary enlarged side elevation showing the adhesive applicator.

The drawings illustrate a high speed apparatus for sealing the free end or tail of a wound roll product 1, such as toilet tissue or paper toweling. In general, the elongated roll has a length of approximately 60 inches to 105 inches and has a diameter of about 4 to 10 inches. The apparatus can be used to seal the tail on an unsplit roll or log or on a split roll which is cut transversely into a series of small sections or rolls which are in intimate end-to-end contact.

The apparatus includes a frame 2 and a pair of parallel rollers 3 are mounted for rotation on frame 2 within generally curved cradles 4. Cradles 4 are supported by brackets 5 on frame. 2.

Figures 2, 3, 4:
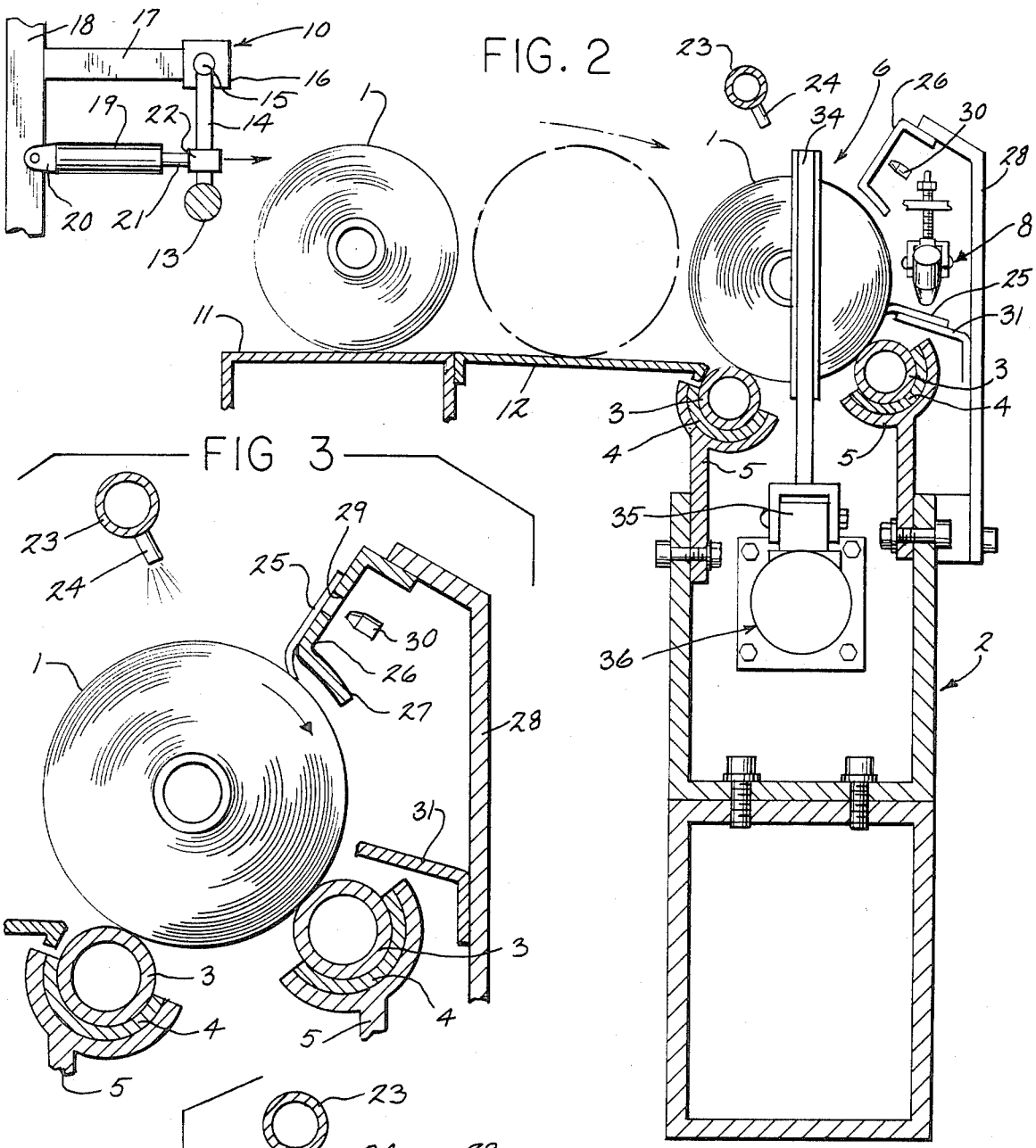
FIG. 2 is a transverse section showing the kicker mechanism for kicking the roll onto the rotating rollers.
FIG. 3 is a transverse section showing the rolls supported on the rollers and the separated tail being drawn across the supporting surface.
FIG. 4 is a view similar to FIG. 3 and showing the separated tail on the apron.

As best illustrated in FIG. 3, rollers 3 are mounted in spaced apart parallel relation with one of the rollers being at a slightly higher elevation than the other. The two rollers 3 define a tail separating station 6 and a wind-up station 7. The roll 1 is introduced laterally from the side of the lowermost of the two rollers by a kicker mechanism as hereinafter described. At the tail separation station 6 the tail is separated from the roll and the roll is then moved longitudinally along the rollers 3 to the wind-up station 7 where the seprated tail, having had a bead of adhesive applied thereto by an adhesive applying mechanism 8, is rewound onto the body of the roll.

Rollers 3 are rotated in the direction of the arrows by a conventional machine drive mechanism indicated generally by 9.

The kicker mechanism 10, as best illustrated in FIG. 2, serves to deliver roll 1 to the tail separating station 6 and includes a platform 11 which is disposed parallel to tail separating station 6. A sloping ramp 12 connects platform 11 to the tail separating station 6.

Kicker mechanism 10 also includes an elongated kicker bar 13 which extends a substantial portion of the length of the roll 1 and is located above a horizontal plane passing through the axis of roll 1 that is supported on platform 11. Kicker bar 13 is supported by a series of vertical supports 14 which, in turn, are journalled about a horizontal shaft 15 by bearing blocks 16. Blocks 16 are connected through braces 17 to frame members 18 that are connected to frame 2.

To pivot the kicker bar 13, a fluid cylinder 19 is interconnected between frame member 18 and supports 14. As shown in FIG. 2, one end of cylinder 19 is pivotally connected to lugs 20 attached to frame member 18, while the piston rod or ram 21 carries a clevis 22 which is pivotally connected to the vertical support 14. With this construction, introducing fluid into one end of cylinder 19 will pivot the kicker bar 13 toward the roll 1 supported on platform 11 and impart rotation to the roll as shown in FIG. 2. The roll being delivered to the tail separating station 6 will thus be rotating in the same direction as the rotation imparted by rollers 2 and 3, thereby enabling roll 1 to quickly come up to desired speed.

To separate the free end of tail from the wound roll as the roll is rotated at the station 6, an air blast mechanism is utilized which includes a manifold 23 that is connected to a source of air, or other gas under pressure, and the air is discharged from the manifold through a series of jets 24. The air discharge is generally tangential against the surface of the roll 1 causing the tail 25 to be moved outwardly from the roll. The released or separated tail 25 is blown against a supporting plate 26 which extends generally radially to the axis of roll 1, as shown in FIG. 3. The air jets 24 are located on one side of a vertical plane passing through the axis of roll 1, as illustrated in FIG. 3, while the support plate 26 is located on the opposite side of the vertical plane. The arc between air jets 24 and support plate 26 is in the range of about 60° to 90°. The upper edge of support plate 26 is provided with a downwardly extending flange which is secured to supporting bracket 28 that in turn is connected to frame 2.

The lower edge of plate 26 is provided with a flange 27 that acts as a stop for the roll 1 as the roll is kicked onto the rollers 2 and 3 by kicker bar 13.

As roll 1 continues to rotate, the separated tail 25 will be drawn inwardly along support plate 26 by continued rotation of the roll. Support plate 26 is provided with a hole 29 and a sensor 30, such as a photoelectric eye, is mounted beneath the support plate in alignment with hole 29. When the free end of the tail 25 passes across the beam of the photoelectric eye 30, a signal is sent to the drive mechanism 8 to stop rotation of the rollers 3.

Due to the high speed of rotation of the roll 1, which can be in the neighborhood of about 90 to 100 rpm, roll 1 will not stop instantaneously and in the time interval between sensing of the end of the tail by the sensor 30 and stopping of rotation, the tail will be drawn completely across support plate 26 and will fall onto apron 31 which extends laterally from one of the rollers 3, as shown in FIGS. 3 and 4. Apron 31 is located approximately 60° to 120° from support plate 26.

Roll 1 with the separated tail 25 supported on apron 31 is then moved longitudinally along the rollers 3 to wind-up station 7 by a pusher assemlby 33. The pusher assembly can be similar to that described in U. S. Pat. No. 4,299,642 and includes a generally vertical pusher 34 which is mounted at the end of the tail separating station 6 and extends vertically between rollers 3. The lower end of pusher 34 is pivotally connected to the end of a ram 35 that is movable within fluid cylinder 36.

By introducing fluid into one end of the cylinder 36, pusher 34 will engage the end of roll 1, moving the roll longitudinally along the rollers 3 to the wind-up station 7. Introducing fluid into the opposite end of cylinder 36 will and return the pusher 34 to its original position. Alternately, for high speed operation, pusher 34 can be pivoted to the ram, so that the pusher will pivot downwardly as it is moved to its return stroke when it engages the fresh roll 1 located at the station 6. When the pusher 34 has returned to its original position, a biasing mechanism will return the pusher to its upright position adjacent the end of the roll as shown in FIG. 1.

As roll 1 is moved from the tail separating station 6 to the wind-up station 7 by pusher assembly 33, a bead or strip or adhesive 37 is applied to the extended tail 25 by a fixed adhesive head 38 which is supported by frame 2. Head 38 is mounted from frame 2 between stations 6 and 7 and is provided with a discharge nozzle 39 through which the adhesive is sprayed under relatively high pressure of about 100 psi onto the extended tail 25 as the tail moves beneath the head. The apron is provided with an opening 40 or notch aligned with the nozzle 39 and if for some reason the tail of the roll is not extended as the roll is pushed from station 6 to station 7, the adhesive will merely pass through the opening 40 to a disposal container and will not contact the apron 31, thereby preventing the tail of a succeeding roll from being contaminated with the adhesive on the apron.

As shown in FIG. 5, the axis of the adhesive head 38 is disposed at an acute angle of about 45° to the horizontal, and generally in the range of about 20° to 50°, and faces in a downstream direction. The discharge of the pressurized adhesive will thus impart a horizontal component of velocity to the tail 25 which is being moved along the apron 31 to prevent the tail from sticking or folding over on the apron as it is moved to the wind-up station 7.

A provision is also incorporated to adjust the angularity of the adhesive nozzle to compensate for the speed of movement of the roll, the velocity of the adhesive being discharged from head 38 and the viscosity of the adhesive. To provide the adjustment, the head 38 is pivotally mounted on a yoke 41 which is connected to frame 2 and the position of attachment of yoke 41 to head 38 is such that the nozzle will be urged downwardly by gravity. Adjusting screw 42 which is threaded within a bracket 43 connected to frame 2 engages the rear end of the head. By adjustment of the screw 42, the angular position of the head can be varied as desired.

In operation, the roll 1, positioned on platform 11, is kicked from the platform through operation of kicker bar 13. Kicker bar 13 is adapted to engage roll 1 in an overcenter location imparting rotation to the roll in the same direction as the roll will be rotated by rollers 3, thereby enabling the roll 1 to attain a higher velocity in a shorter period of time on the rollers 3.

As the tail on roll 1 moves to a location adjacent the air jets 24, which will be less than one revolution of roll 1, tail 25 will be blown outwardly or separated and draped across the support plate 26. Continued rotation of roll 1 will draw the separated tail across surface 26 and when the end of the tail passes the sensor 30, rotation of roll 1 is stopped. The inertia of the roll will draw the tail 25 from surface 26 and it will fall onto apron 31. Pusher assembly 33 will then move the roll, with the separated tail supported on apron 31, to the wind-up station 7, and as the roll is moved, a bead of adhesive is applied to the extended tail by head 38.

At the wind-up station 7, the roll is again rotated—while is a second roll is being rotated at the tail separation station 6—to attach the tail to the roll. The roll is then removed laterally from the wind-up station by a suitable kicker mechanism.

The apparatus of the invention enables the tail sealing operation to be carried out at high speeds heretofore not obtainable.

Various modes of carrying out the invention are contemplated as being within the scope of the following claims particularly pointing out and distinctly claiming the subject matter which is regarded as the invention.

I claim:

1. An improved high speed apparatus for sealing the tail of a roll product, comprising a supporting structure defining a tail separating station and a wind-up station, said supporting structure including a pair of generally parallel rollers that define said tail separating station and said tail wind-up station, said stations being disposed longitudinally of said rollers, drive means for rotating the roll about its axis at the tail separating station, tail separating means disposed at the tail separating station for separating the tail from the body of the roll as the roll is rotated, tail support means disposed downstream in the direction of rotation of said roll from said tail separating means and including a supporting surface to support the separated tail, sensing means associated with said tail support means for sensing the end of the tail as the tail is drawn over said surface by continued rotation of said roll, said sensing means being connected to the drive means and operable to stop rotation of the drive means when the end of the tail is sensed by said sensing means, an apron disposed downstream in the direction of rotation from said tail support means for supporting the separated tail after the tail is drawn over said tail support means, conveying means for moving the roll with the separated tail from the tail separating station to the wind-up station, adhesive applying means mounted at a level above the apron for applying a strip of adhesive to the separated tail as the roll is moved to the wind-up station, and means for rotating the roll at the wind-up station to rewind the tail onto the body of the roll.

2. The apparatus of claim 1, wherein said tail support means is located at an arc in the range of 60° to 90° from said tail separating means.

3. The apparatus of claim 2, wherein said tail separating means includes a plurality of jets disposed generally tantengially to said roll, said jets being connected to a source of gas under pressure.

4. The apparatus of claim 2, wherein said apron is located at an arc in the range of 60° to 90° from said tail support means.

5. The apparatus of claim 1, wherein said surface is generally flat and provided with an opening, said sensing means being mounted in alignment with said opening.

6. The apparatus of claim 1, wherein said apron is disposed in a generally horizontal plane.

7. A method of sealing a tail of a roll product, comprising the steps of positioning a roll at a tail separating station, rotating the roll at said station, separating the tail from the body of the rotating roll, supporting the separated tail on a surface spaced in the direction of rotation from the location of the tail separation, continued rotation of the roll drawing the tail across said surface, sensing the end of the tail as the tail is drawn across said surface, stopping rotation of said roll on sensing of the end of said tail, supporting the separated tail after it is drawn from said surface on a generally horizontal apron, moving the roll with the separated tail supported on said apron longitudinally to a wind-up station, applying a strip of adhesive to the separated tail as the roll is moved to the wind-up station, and rotating the roll at the wind-up station to rewind the tail onto the body of the roll.

* * * * *